US007990057B2

(12) United States Patent
Yamashita et al.

(10) Patent No.: US 7,990,057 B2
(45) Date of Patent: Aug. 2, 2011

(54) SURFACE EMITTING-TYPE ELECTROLUMINESCENT DEVICE

(75) Inventors: Seiji Yamashita, Kanagawa (JP); Tadanobu Sato, Kanagawa (JP); Masashi Shirata, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 215 days.

(21) Appl. No.: 12/301,593

(22) PCT Filed: May 25, 2007

(86) PCT No.: PCT/JP2007/060729

§ 371 (c)(1), (2), (4) Date: Nov. 19, 2008

(87) PCT Pub. No.: WO2007/139032

PCT Pub. Date: Dec. 6, 2007

(65) Prior Publication Data

US 2009/0167172 A1 Jul. 2, 2009

(30) Foreign Application Priority Data

May 26, 2006 (JP) ..... P2006-146675

(51) Int. Cl.
*H01J 1/62* (2006.01)

(52) U.S. Cl. ..... 313/506; 313/498

(58) Field of Classification Search ..... 313/498–512
See application file for complete search history.

(56) References Cited

FOREIGN PATENT DOCUMENTS

| | | | |
|---|---|---|---|
| JP | 58-112299 | A | 7/1983 |
| JP | 62-116359 | A | 5/1987 |
| JP | 2000-150166 | A | 5/2000 |
| JP | 2002-198178 | A | 7/2002 |
| JP | 2005-339924 | A | 12/2005 |
| JP | 2006-4658 | A | 1/2006 |

*Primary Examiner* — Joseph L Williams
(74) *Attorney, Agent, or Firm* — Birch, Stewart, Kolasch & Birch, LLP

(57) ABSTRACT

A surface emitting-type electroluminescent device capable of being driven by a DC power source and excellent in durability is provided.

A surface emitting-type electroluminescent device containing a stacked structure in which a transparent electrical conductor layer, a transparent semiconductor layer and/or a transparent insulator layer, a light-emitting layer and a back electrode layer are arrayed in this order, the transparent electrical conductor layer, the transparent semiconductor layer and the transparent insulator layer each containing a metal oxide.

3 Claims, 1 Drawing Sheet

SURFACE EMITTING-TYPE ELECTROLUMINESCENT DEVICE

TECHNICAL FIELD

The present invention relates to a surface emitting-type electroluminescent device.

BACKGROUND ART

The planar emission-type electroluminescent device (hereinafter sometimes referred to as an "EL device") includes, for example, a dispersion-type inorganic EL device where a fluorescent particle is dispersed in a binder having a high dielectric constant (for example, Patent Document 1), a thin film-type inorganic EL device where a dielectric layer having a high dielectric constant and a thin-film light-emitting layer are stacked, and an organic EL device having a structure where an electron transport layer, a hole transport layer and a light-emitting layer each comprising an organic material are stacked.

Patent Document 1: JP-A-2005-339924

Patent Document 2: JP-A-58-112299

Patent Document 3: JP-A-62-116359

Non-Patent Document 1: Keikotai Handbook (Phosphor Handbook), Edition II, Chapter 2, compiled by Keikotai Dogakukai, Ohm-Sha Non-Patent Document 2: Toshio Inoguchi, Electro-luminescent Display, Sangyo Tosho Non-Patent Document 3: Seizo Miyata (compiler), Yuki EL Soshi to Sono Kogyoka Saizensen (Organic EL Device and Front Line of Its Industrialization), NTS

DISCLOSURE OF THE INVENTION

Problems that the Invention is to Solve

Out of these devices, the dispersion-type inorganic EL device and the thin film-type inorganic EL device each generally has a structure where an insulating dielectric layer is sandwiched between an electrode and a light-emitting layer, and emits light only by AC driving at a relatively high voltage of around 100 V and therefore, a inverter circuit is necessary. Also, since the device becomes a capacitive load for the driving power source, the circuit current value becomes large with respect to the consumed current and this gives rise to a problem, for example, that the power source size increases.

The organic EL device can be driven by a direct current, but this device is composed of an organic material and therefore, suffers from insufficient durability.

Under these circumstances, the present invention has been made and aims to provide a DC driving surface-emitting electroluminescent device using an inorganic material and being excellent in durability and solve those problems in conventional techniques.

The present invention provides an electroluminescent device containing a stacked structure in which a transparent electrical conductor layer, a transparent semiconductor layer and/or a transparent insulator layer, a light-emitting layer and a back electrode layer are arrayed in this order, the transparent electrical conductor layer, the transparent semiconductor layer and the transparent insulator layer each containing a metal oxide. The upper part above the light-emitting layer is entirely composed of a transparent material, so that light can be extracted as planar emission and high brightness can be realized.

Means for Solving the Problems

The object of the present invention can be attained by the following matters specifying the present invention and preferred embodiments thereof.

(1) A surface emitting-type electroluminescent device containing a stacked structure in which a transparent electrical conductor layer, a transparent semiconductor layer and/or a transparent insulator layer, a light-emitting layer and a back electrode layer are arrayed in this order, the transparent electrical conductor layer, the transparent semiconductor layer and the transparent insulator layer each containing a metal oxide.

(2) The surface emitting-type electroluminescent device as in (1), wherein the transparent semiconductor layer and/or the transparent insulator layer each contains at least one element selected from the group consisting of elements belonging to Groups 12, 13 and 14 of the Periodic Table.

(3) The surface emitting-type electroluminescent device as in (1) or (2), wherein the substance constituting the light-emitting layer is a compound semiconductor containing at least one element selected from the group consisting of Group 2 elements and Group 16 elements of the Periodic Table and/or at least one element selected from the group consisting of Group 13 elements and Group 15 elements of the Periodic Table.

Advantage of the Invention

According to the present invention, a surface emitting-type electroluminescent device capable of being driven by a DC power source and assured of excellent durability and high brightness can be provided.

BEST MODE FOR CARRYING OUT THE INVENTION

Figure 1:
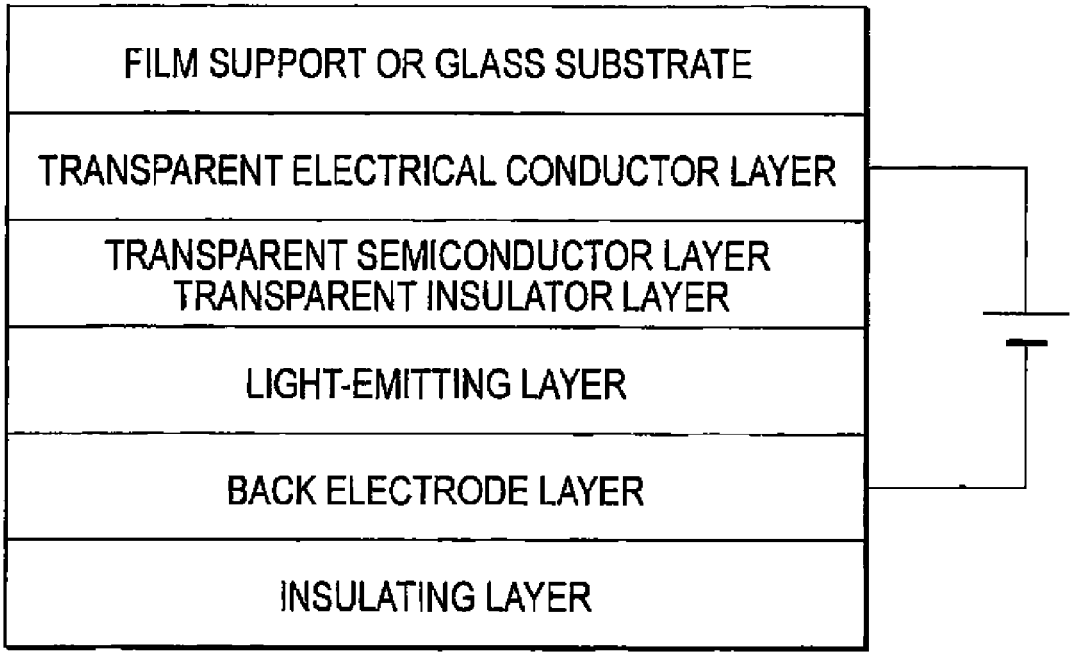
FIG. 1 A cross-sectional schematic view showing one embodiment of the surface emitting-type electro-luminescent device of the present invention.

The surface emitting-type electroluminescent device of the present invention is characterized by containing a stacked structure in which a transparent electrical conductor layer, a transparent semiconductor layer and/or a transparent insulator layer, a light-emitting layer and a back electrode layer are arrayed in this order, the transparent electrical conductor layer, the transparent semiconductor layer and the transparent insulator layer each containing a metal oxide.

The embodiment of the present invention is described in detail below based on the drawing.

FIG. 1 is a schematic view showing the preferred construction of the surface emitting-type electro-luminescent device according to the present invention.

As shown in FIG. 1, the surface emitting-type electroluminescent device comprises a support such as film support or glass substrate and preferably has a stacked structure where a transparent electrical conductor layer, both a transparent semiconductor layer and a transparent insulator layer or either a transparent semiconductor layer or a transparent insulator layer, a light-emitting layer, a back electrode layer and an insulating layer are arrayed in this order on the support. A DC power source is preferably connected to the transparent electrical conductor layer and the back electrode layer.

In the case of having both a transparent semi-conductor layer and a transparent insulator layer, the order is preferably a support/a transparent electrical conductor layer/a transparent semiconductor layer/a transparent insulator layer/a light-emitting layer/a back electrode layer/an insulating layer.

In the present invention, DC driving is enabled by achieving a device structure where the insulating layer (dielectric layer) is not sandwiched.

(Support)

In the surface emitting-type EL device of the present invention, a transparent electrical conductor layer is preferably formed on an insulating transparent support. The support which can be used here is preferably a film comprising an organic material or a plastic substrate. The substrate indicates a member on which a transparent electrical conductor layer is formed. In the case of a film, a high-molecular polymer material which is an organic material may be preferably used. Examples of the film comprising an organic material include a transparent film such as polyethylene terephthalate, polyethylene naphthalate or triacetyl cellulose base. Examples of the plastic substrate include polyethylene, polypropylene, polyamide, polycarbonate and polystyrene.

Other than those described above, a flexible transparent resin sheet, a glass substrate or a ceramic substrate may also be used.

The thickness of the support is preferably from 30 μm to 1 cm, more preferably from 50 to 1,000 μm.

(Transparent Electrical Conductor Layer)

The transparent electrical conductor layer for use in the present invention preferably has a surface resistance value of 0.01 to 10 Ω/sq., more preferably from 0.01 to 1 Ω/sq.

The surface resistance value of the transparent electrically conducting film can be measured according to the method described in JIS K6911.

The transparent electrically conducting film can be formed on a film and is obtained by attaching and film-forming a transparent electrically conductive material such as indium-.tin oxide (ITO), tin oxide and zinc oxide, for example, on a transparent film such as polyethylene terephthalate, polyethylene naphthalate or triacetyl cellulose base by a method such as vapor deposition, coating and printing.

In this case, for the purpose of increasing the durability, the surface of the transparent electrical conductor layer is preferably a layer mainly comprising tin oxide.

The preparation method of the transparent electrically conducting film may be a vapor phase method such as sputtering and vacuum vapor deposition. Also, past-like ITO or tin oxide may be applied by coating or screen-printing and film-formed by heating the entire film or under heating with a laser. In this case, a transparent film having higher heat resistance may be preferably used.

In the surface emitting-type EL device of the present invention, an arbitrary transparent electrode material generally employed is used for the transparent electrical conductor layer. Examples thereof include a metal oxide such as tin-doped tin oxide, antimony-doped tin oxide, zinc-doped tin oxide, fluorine-doped tin oxide and zinc oxide; a multilayer structure in which a thin silver film is sandwiched between high refractive index layers; and a conjugated polymer such as polyaniline and polypyrrole.

In the case of attaining a lower resistance than with such a material alone, the electric conduction is preferably improved, for example, by disposing a thin metallic wire of comb type, grid type or the like in a network or striped pattern. As for the thin metallic or alloy wire, copper, silver, aluminum nickel or the like is preferably used. The thin metallic wire may have an arbitrary size, hut the size is preferably between about 0.5 μm and 20 μm. The thin metallic wire is preferably disposed at intervals with a pitch of 50 to 400 μm, more preferably from 100 to 300 μm. When the thin metallic wire is disposed, the transmittance of light decreases. It is important that this decrease is as small as possible, and a transmittance of 80% to less than 100% is preferably ensured.

As for the thin metallic wire, a mesh may be laminated to a transparent electrically conductive film or a metal oxide or the like may be coated or vapor deposited on a thin metallic wire previously formed on a film by vapor deposition or etching through a mask. Furthermore, the above-described thin metallic wire may be formed on a previously formed thin metal oxide film.

Although different from these methods, instead of the thin metallic wire, a thin metal film having an average thickness of 100 nm or more may be stacked with a metal oxide to form a transparent electrically conducting film suitable for the present invention. The metal used for the thin metal film is preferably a metal having high corrosion resistance and being excellent in the ductility and the like, such as Au, In, Sn, Cu and Ni, but the present invention is not limited thereto.

Such a multilayer film preferably realizes a high light transmittance and preferably has a light transmittance of 70% or more, more preferably 80% or more. The wavelength used for specifying the light transmittance is 550 nm.

The thickness of the transparent electrical conductor layer is preferably from 30 nm to 100 μm, more preferably from 50 nm to 10 μm.

(Transparent Semiconductor Layer•Transparent Insulator Layer)

The transparent semiconductor layer and/or transparent insulator layer for use in the present invention are provided between the transparent electrical conductor layer and the light-emitting layer and contains a metal oxide.

The element which can be contained in the transparent semiconductor layer and transparent insulator layer is preferably an element of Group 2, Group 3, Group 9, Group 12 (old Group 2B (old Group IIb)), Group 13 (old Group 3B (old Group III)), Group 14 (old Group 4B (old Group IV)), Group 15 or Group 16 of the Periodic Table, more preferably at least one element selected from the group consisting of elements of Group 12, Group 13 and Group 14. Specific examples thereof include Ga, In, Sn, Zn, Al, Sc, Y, La, Si, Ge, Mg, Ca, Sr, Rh and Ir, with Ga, In, Sn, Zn, Si and Ge being preferred.

Other than these elements, the transparent semi-conductor may preferably contain a chalcogenide (e.g., S, Se, Te), Cu, Ag or the like.

Also, the transparent semiconductor layer and/or transparent insulator layer preferably contain an element selected from Group IIIB and/or Group VB elements of the Periodic Table. One of these elements or a plurality of the elements above may be used.

The transparent insulator layer is described in detail in *Kino Zairyo* (*Functional Materials*), Vol. 25, No. 4, pp. 5-73 (April, 2005), and *OPTRONICS*, No. 10, pp. 116-165 (2004), and those described therein may be preferably used also in the present invention.

Examples of the transparent semiconductor include the followings:

LaCuOS, LaCuOSe, LaCuOTe $SrCu_2O_2$ $ZnO—Rh_2O_3$, $ZnRh_2O_4$ $CuAlO_2$

The transparent semiconductor is described in detail in *Gekkan Optronics* (*Monthly Optronics*), pp. 115-165 (October, 2004), and *Kino Zairyo* (*Functional Materials*), Vol. 25, No. 4 (April, 2005).

In the electroluminescent device of the present invention, the thickness of the transparent semiconductor layer and transparent insulator layer is preferably from 1 nm to 100 μm, more preferably from 1 nm to 1 μm. The light transmittance of the layer is preferably 80% or more in terms of light transmittance at 550 nm.

(Light-Emitting Layer)

The light-emitting layer for use in the present invention is provided between the transparent semiconductor layer and/or transparent insulator layer and the back electrode layer.

In the electroluminescent device of the present invention, the thickness of the light-emitting layer is preferably from 0.1 to 100 μm, more preferably from 0.1 to 3 μm.

For the light-emitting layer, a semiconductor containing at least one element selected from the group consisting of Group 2 (old Group 2A (old Group II)) elements and Group 16 (old Group 6B (old Group VI)) elements of the Periodic Table and/or at least one element selected from the group consisting of Group 13 (old Group 3B (old Group III)) elements and Group 15 (old Group 5B (old Group V)) elements of the Periodic Table may be preferably used.

In the light-emitting layer, Group II-VI and Group III-V compound semiconductors may be preferably used. Also, an N-type semiconductor is preferred. The carrier density is preferably $10^{17}$ $cm^{-3}$ or less, and a donor-acceptor-type luminescence center is preferred.

Specific examples of the substance forming the light-emitting layer include CdS, CdSe, Cdfe, ZnS, ZnSe, ZnTe, CaS, MgS, SrS, GaP, GaAs, GaN, InP, InAs and a mixed crystal thereof, and ZnS, ZnSe, CaS and the like may be preferably used.

Furthermore, $BaAl_2S_4$, $CaGa_2S_4$, $Ga_2O_3$, $Zn_2SiO_4$, $Zn_2GaO_4$, $ZnGa_2O_4$, $ZnGeO_3$, $ZnGeO_4$, $ZnAl_2O_4$, $CaGa_2O_4$, $CaGeO_3$, $Ca_2Ge_2O_7$, CaO, $Ga_2O_3$, $GeO_2$, $SrAl_2O_4$, $SrGa_2O_4$, $SrP_2O_7$, $MgGa_2O_4$, $Mg_2GeO_4$, $MgGeO_3$, $BaAl_2O_4$, $Ga_2Ge_2O_7$, $BeGa_2O_4$, $Y_2SiO_5$, $Y_2GeO_5$, $Y_2Ge_2O_7$, $Y_4GeO_8$, $Y_2O_3$, $Y_2O_2S$, $SnO_2$, a mixed crystal thereof and the like may be preferably used.

The carrier density and the like can be determined, for example, by a hole effect measuring method generally employed in the art.

(Back Electrode Layer)

The back electrode layer for use in the present invention is disposed on the light-emitting layer and is preferably provided between the light-emitting layer and the insulating layer.

For the back electrode layer on the side from which light is not extracted, an arbitrary material having electrical conductivity can be used. A material is appropriately selected from a metal such as gold, silver, platinum, copper, iron and aluminum, and graphite according to the mode of the device fabricated, the temperature in the fabrication process, and the like. Above all, it is important that the heat conductivity is high, and the heat conductivity is preferably 2.0 W/cm·deg or more.

Also, for ensuring high heat radiation and electric conduction, a metal sheet or a metal mesh may be preferably used in the periphery of the EL device.

(Insulating Layer)

In the present invention, an insulating layer may also be provided on the back electrode layer.

The insulating layer may be formed, for example, by vapor-depositing or coating a liquid dispersion or the like where an insulating inorganic material, polymer material or inorganic material powder is dispersed in a polymer material.

(Power Source)

The surface emitting-type electroluminescent device of the present invention is preferably driven by a direct current. The driving voltage is preferably 30 V or less, more preferably from 1 to 15 V, still more preferably from 2 to 10 V.

Examples of the thin film forming method which can be preferably used for the formation of the transparent electrical conductor layer, transparent semiconductor layer, transparent insulator layer, light-emitting layer and the like include a sputtering method, an electron beam deposition method, a resistance heating deposition method, a chemical vapor deposition method (CVD method), and a plasma CVD method.

(Others)

In the device construction of the present invention, a substrate, a reflection layer, various protective layers, a filter, a light-scattering reflection layer and the like may be added, if desired.

FIG. 1 shows a specific construction example of the present invention.

While the present invention has been described in detail and with reference to specific embodiments thereof, it will be apparent to one skilled in the art that various changes and modifications can be made therein without departing from the spirit and scope of the present invention.

This application is based on Japanese Patent Application (Patent Application No. 2006-146675) filed on May 26, 2006, the contents of which are incorporated herein by way of reference.

The invention claimed is:

1. A surface emitting-type electroluminescent device comprising a stacked structure in which a transparent electrical conductor layer, a transparent semiconductor layer and/or a transparent insulator layer, a light-emitting layer and a back electrode layer are arrayed in this order, said transparent electrical conductor layer, said transparent semiconductor layer and said transparent insulator layer each comprising a metal oxide;

wherein the light-emitting layer is directly in contact with the back electrode layer.

2. The surface emitting-type electroluminescent device as claimed in claim 1, wherein said transparent semiconductor layer and/or said transparent insulator layer each comprises at least one element selected from the group consisting of elements belonging to Groups 12, 13 and 14 of the Periodic Table.

3. The surface emitting-type electroluminescent device as claimed in claim 1 or 2, wherein a substance constituting said light-emitting layer is a compound semiconductor comprising at least one element selected from the group consisting of Group 2 elements and Group 16 elements of the Periodic Table and/or at least one element selected from the group consisting of Group 13 elements and Group 15 elements of the Periodic Table.

* * * * *